US011279529B2

(12) United States Patent
Berroa Garcia

(10) Patent No.: US 11,279,529 B2
(45) Date of Patent: Mar. 22, 2022

(54) STOPPER FOR BOTTLES

(71) Applicant: BETAPACK, S.A.U., Irun (ES)

(72) Inventor: Javier Berroa Garcia, Irun (ES)

(73) Assignee: BETAPACK, S.A.U., Irun (ES)

( * ) Notice: Subject to any disclaimer, the term of this patent is extended or adjusted under 35 U.S.C. 154(b) by 33 days.

(21) Appl. No.: 16/770,591

(22) PCT Filed: Dec. 7, 2017

(86) PCT No.: PCT/ES2017/070800
§ 371 (c)(1),
(2) Date: Jun. 6, 2020

(87) PCT Pub. No.: WO2019/110853
PCT Pub. Date: Jun. 13, 2019

(65) Prior Publication Data

US 2021/0163190 A1 Jun. 3, 2021

(51) Int. Cl.
*B65D 47/08* (2006.01)
*B65D 51/24* (2006.01)

(52) U.S. Cl.
CPC ..... *B65D 47/0838* (2013.01); *B65D 51/242* (2013.01); *B65D 2203/12* (2013.01); *B65D 2251/1008* (2013.01)

(58) Field of Classification Search
CPC ..... B65D 47/06; B65D 47/08; B65D 47/20; B65D 51/24; B65D 51/47038; B65D 47/063; B65D 51/242; B65D 41/0478; B65D 41/0471; B65D 41/28; B65D 47/0842; B65D 47/0819; B65D 47/0823; B65D 47/0828; B65D 47/0833; B65D 47/0838; B65D 47/0814; B65D 47/2031; B65D 55/024; B65D 2401/15
USPC ..... 215/235, 237; 220/840; 222/153.07, 222/546, 556
See application file for complete search history.

(56) References Cited

U.S. PATENT DOCUMENTS

| | | | | |
|---|---|---|---|---|
| 4,793,501 | A * | 12/1988 | Beck | B65D 47/0838 215/235 |
| 7,051,888 | B2 | 5/2006 | Antier et al. | |
| 2002/0096532 | A1 | 7/2002 | Berge et al. | |
| 2003/0034323 | A1 | 2/2003 | Smith et al. | |
| 2006/0011667 | A1* | 1/2006 | Skillin | B65D 47/0828 222/556 |
| 2006/0231518 | A1 | 10/2006 | Suffa | |
| 2007/0102390 | A1* | 5/2007 | Hoepner | B65D 47/0885 215/235 |

(Continued)

FOREIGN PATENT DOCUMENTS

| | | | |
|---|---|---|---|
| EP | 2189387 | A1 | 5/2010 |
| FR | 2802182 | A1 | 6/2001 |

(Continued)

*Primary Examiner* — Anthony D Stashick
*Assistant Examiner* — Prince Pal
(74) *Attorney, Agent, or Firm* — John A. Fortkort; Fortkort & Houston PC

(57) ABSTRACT

Stopper for bottles, comprising a pouring element (1) assembled with a hinged closing cap (2), the closing cap (2) being able to be placed in an open position and a closed position, characterized in that said closing cap (2) comprises a protrusion (3) in its closest part to the pouring element (1), whose protrusion (3) contacts the pouring element (1) in the open position of the closing cap (2).

13 Claims, 2 Drawing Sheets

(56) References Cited

U.S. PATENT DOCUMENTS

| | | | | |
|---|---|---|---|---|
| 2007/0102391 | A1* | 5/2007 | Hoepner | B65D 47/0885 215/235 |
| 2007/0251949 | A1* | 11/2007 | Barre | B65D 47/0871 220/890 |
| 2009/0152269 | A1* | 6/2009 | Pucci | B65D 47/0823 220/254.3 |
| 2010/0065589 | A1 | 3/2010 | Skillin | |
| 2010/0140268 | A1* | 6/2010 | Lohrman | B65D 47/36 220/270 |
| 2012/0067922 | A1* | 3/2012 | Benoit-Gonin | B65D 55/024 222/153.06 |
| 2012/0312832 | A1* | 12/2012 | Lane | B65D 51/242 220/833 |
| 2013/0319966 | A1* | 12/2013 | Lane | A45F 3/18 215/237 |
| 2015/0028043 | A1* | 1/2015 | Naesje | B65D 51/18 220/715 |
| 2015/0282654 | A1* | 10/2015 | Kurabe | B65D 43/163 220/254.5 |

FOREIGN PATENT DOCUMENTS

| | | | | |
|---|---|---|---|---|
| WO | 02098756 | A2 | 12/2002 | |
| WO | 02098756 | A3 | 12/2002 | |
| WO | 2006026836 | A1 | 3/2006 | |
| WO | WO-2014189513 | A1 * | 11/2014 | B65D 47/0814 |

* cited by examiner

STOPPER FOR BOTTLES

CROSS-REFERENCE TO RELATED APPLICATIONS

This application is a 371 PCT national application claiming priority to PCT/ES2017/070800, filed Dec. 7, 2017, having the same title and inventor, and which is incorporated herein by reference in its entirety.

DESCRIPTION

The present invention relates to a stopper for bottles, comprising a pouring element assembled with a hinged closing cap for its engagement to the neck of a bottle.

BACKGROUND OF THE INVENTION

The use of stoppers for the closure of bottles is common. One type of these stoppers is formed by a pouring element assembled with a hinged closing cap that is attached to the neck of the bottle and a closing cap that serves to close the bottle. This pouring element and the closing cap are hinged with each other by means of a hinge, so that the user can open and close the bottle by articulating the cap backwardly of the pouring element to open the bottle and articulating the cap forwardly to re-close the bottle.

This type of stopper permits the user to easily open and close the bottle several times, without the possibility of the stopper being lost, since the pouring element remains permanently attached to the neck of the bottle.

It is usual for the user to drink directly from the bottle when using this type of stopper, but the closing cap hinged to the pouring element can be uncomfortable for it. This is because the stopper does not comprise any means to retain the closing cap in its open position.

Therefore, an object of the present invention is to provide a stopper that allows the closing cap to be placed in its open position stably and with the widest possible opening angle, and which provides feedback to the user that the closing cap is in its open or closed position.

DISCLOSURE OF THE INVENTION

With the stopper for bottles of the invention said disadvantages are solved, presenting other advantages that will be described below.

The present invention refers to a stopper for bottles, comprising a pouring element assembled with a hinged closing cap for its engagement to the neck of a bottle, the closing cap being able to be placed in an open position and a closed position, and it is characterized in that said closing cap comprises a protrusion in its closest part to the pouring element, whose protrusion interferes with the pouring element in the open position of the closing cap.

According to a preferred embodiment, the protrusion is semicircular in shape and made from a flexible material.

Furthermore, the protrusion is advantageously circumscribed within a circle defined in the pouring element.

The presence of this protrusion allows a greater opening than in conventional bottle stoppers, even more than 180°. Furthermore, the protrusion also provides information to the user that it has been placed in its open or closed position, as it causes an acoustic signal, such as a click, when the closure element is placed in any of these positions. Furthermore, the protrusion prevents the closing cap from unintentionally returning to its closed position, holding the closing cap stably in its open position.

The fact that the protrusion is circumscribed within a defined circle of the pouring element, that is, seen in plan, that does not protrude from the pouring element, facilitates its assembly in an automatic assembly machine.

Advantageously, the pouring element and the closing cap are hinged with each other by means of a hinge formed by two arms, between which said protrusion is arranged.

Furthermore, the closing cap comprises a cavity located next to said protrusion, which prevents the closing cap from limiting its degree of opening when it comes into contact with the pouring element.

To facilitate its automated handling, the pouring element comprises at least one lateral flange that protrudes from said pouring element. In particular, it comprises two lateral flanges that extend from the hinge between the pouring element and the closing cap towards the opposite side, leaving a space between the flanges.

Furthermore, the closing cap advantageously comprises a closing collar that is engaged to a nozzle of the pouring element, said closing collar comprising a recess in the area closest to the hinge between the pouring element and the closing cap. This recess facilitates the engagement between the closing collar and the nozzle.

The pouring element may also advantageously comprise a cantilever cover, which comprises a plurality of ribs in its lower part. This cover facilitates the opening of the stopper, and the ribs reinforce said cover using the least possible material, with its consequent cost and weight savings.

BRIEF DESCRIPTION OF THE DRAWINGS

For better understanding of what has been disclosed, some drawings in which, schematically and only by way of a non-limiting example, a practical case of embodiment is shown.

DESCRIPTION OF A PREFERRED EMBODIMENT

As shown in the figures, the stopper for bottles according to the present invention comprises a pouring element, generally identified by reference number 1, and a closing cap, generally identified by reference number 2.

The pouring element 1 is attached to the neck of a bottle, not shown, for example, by an engaging thread or cord. This pouring element 1 is designed so that during its normal use it does not separate from the bottle.

Figure 1:
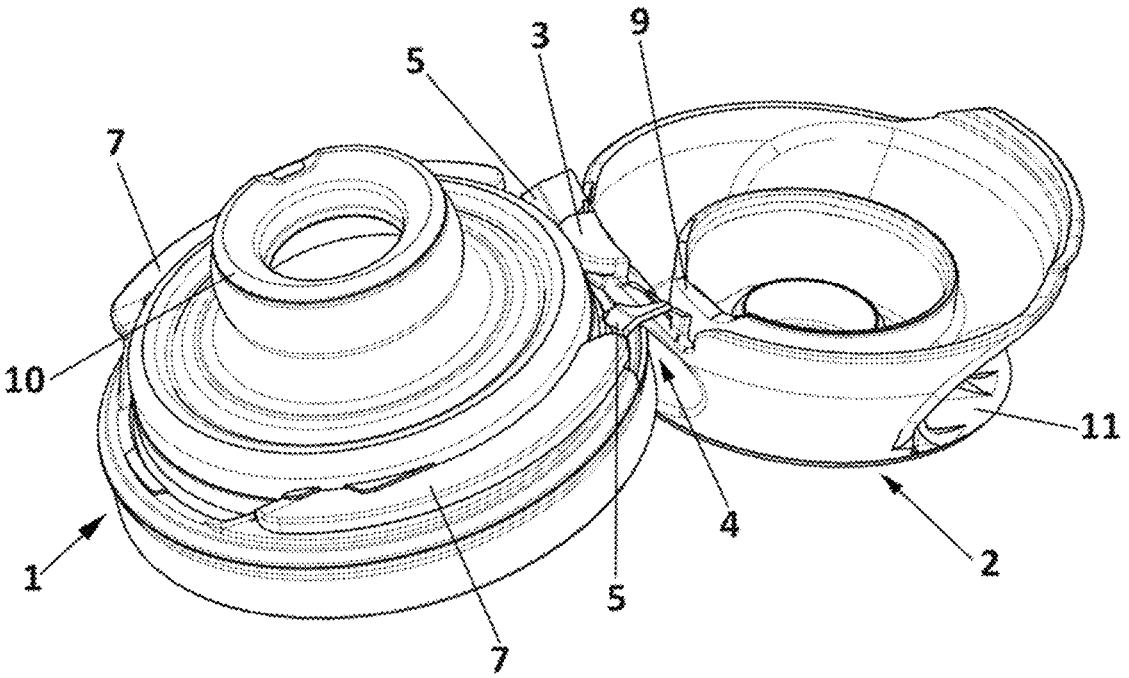
FIG. 1 is a perspective view of the stopper for bottles according to the present invention in its open position.
Figure 2:
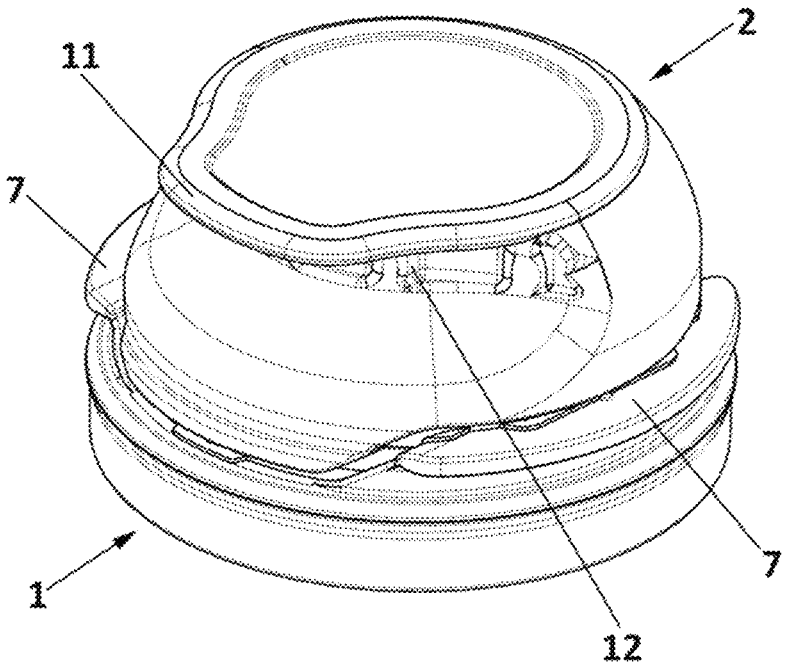
FIG. 2 is a front perspective view of the stopper for bottles according to the present invention in its closed position.
Figure 3:
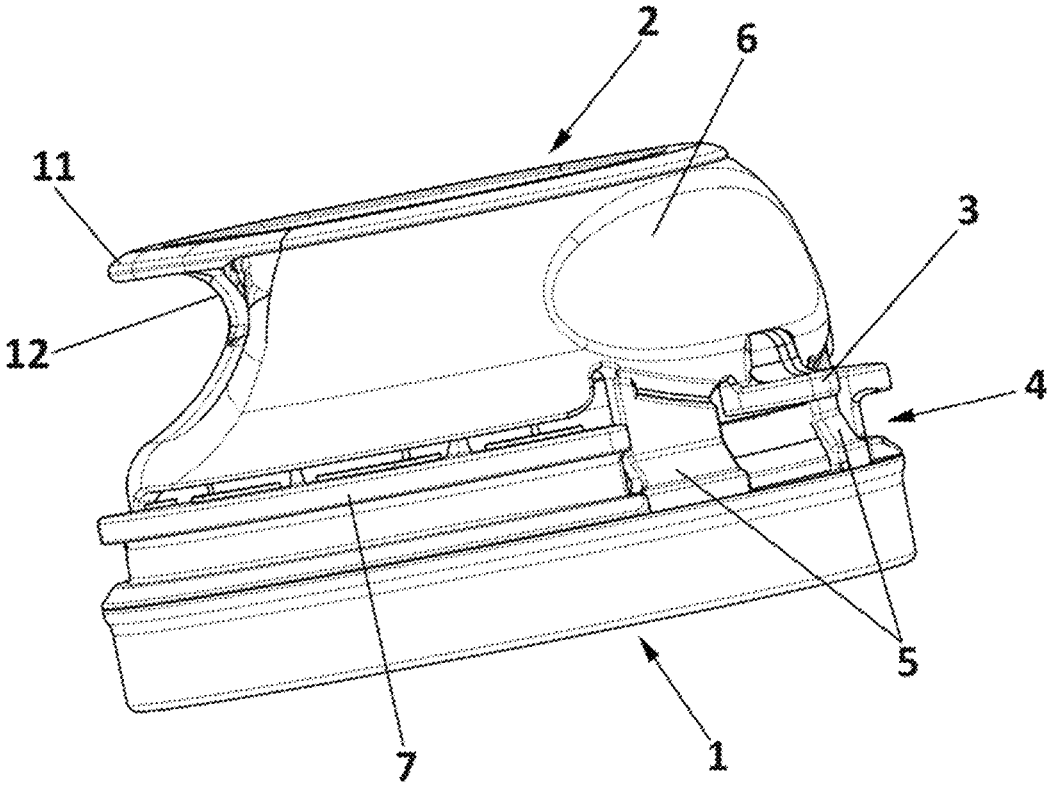
FIG. 3 is a rear perspective view of the stopper for bottles according to the present invention in its closed position.

On the other hand, the closing cap 2 is mounted hinged to said pouring element 1 by means of a hinge 4, and it can be placed in an open position (shown in FIG. 1) or in a closed position (shown in FIGS. 2 and 3).

According to the present invention, the stopper for bottles comprises a protrusion 3 in its closest part to the pouring element 1, as can be seen in the figures. This protrusion 3 contacts the pouring element 1 in the open position of the closing cap 2. For example, this protrusion 3 contacts a circular wall of the pouring element 1 of the stopper.

The function of this protrusion 3 is to provide the user with an indication that the closing cap 2 has been placed in its open or closed position, as it will provide feedback to the user, such as an acoustic indication by clicking. For this purpose, the protrusion 3 is preferably made from a flexible plastic material.

Furthermore, the protrusion 3, which is preferably semicircular in shape, acts as an abutment to retain the closing cap 2 in its open position, preventing its accidental movement.

The hinge 4 between the pouring element 1 and the closing cap 2 is formed, according to the shown embodiment, by two arms 5, defining a space between them, the protrusion 3 being arranged between both arms 5.

As can be seen in FIG. 1, the pouring element 1 comprises a nozzle 10, which facilitates the pouring of the liquid contained in the bottle or that the user drinks directly from the bottle using the nozzle of the pouring element.

Furthermore, the pouring element 1 also comprises lateral flanges 7 that protrude from said pouring element, which facilitate manipulation of the stopper in an automated manner. In particular, the pouring element 1, according to the shown embodiment, comprises two lateral flanges 7 that extend from the hinge between the pouring element 1 and the closing cap 2 towards the opposite side, leaving a space between the flanges 7.

The closing cap 2 comprises a cover 11 in its upper part that extends in a cantilevered manner, under which a plurality of ribs 12 extend for its reinforcement, using the least possible material, with the consequent economic and weight saving. This cantilevered cover 11 facilitates the opening of the bottle, thanks to which it is possible to change the closing cap 2 from its closed position to its open position.

The closing cap 2 also comprises a cavity 6 in its rear part next to the protrusion 3, as can be seen in FIG. 3. This cavity 6 prevents the closing cap 2 from abutting the pouring element 1 before reaching the open position. According to the shown embodiment, this cavity 6 has an oval shape, although it could have any other suitable shape.

The closing cap 2 also comprises a closing collar 8, which in the closed position of the closing cap 2, engages with the nozzle 10 of the pouring element 1. To facilitate this engagement, the closing collar 8 comprises a recess 9 in its part closest to the pouring element 1, as can be seen in FIG. 1.

From its closed position, when a user wishes to open the stopper according to the present invention, he/she must move the closing cap 2 from its closed position to its open position.

To this end, he/she must push the cantilevered cover 11 upwardly, so that the closing cap 2 rotates around the hinge 4 until the protrusion 3 abuts with the pouring element 1. At the moment it abuts, the protrusion 3 will flex and provide an acoustic signal with a click, to inform the user that it has reached the open position.

This open position, preferably with an opening degree greater than 180°, will remain stable thanks to the presence of said protrusion 3, facilitating the pouring of the liquid contained in the bottle or its drink directly from the bottle.

To close the stopper, the user will push up the closing cap 2 to rotate around the hinge 4, overcoming the resistance of the protrusion 3 against the pouring element 1 and causing the closing cap 2 to engage on the pouring element 1 in its closed position.

Although reference has been made to specific embodiments of the invention, it is apparent to a person skilled in the art that the disclosed stopper for bottles is susceptible of numerous variations and modifications, and that all the details mentioned can be replaced by other technically equivalents, without departing from the scope of protection defined by the appended claims.

What is claimed is:

1. A stopper for bottles, comprising:

a pouring element (1) which is attachable to the neck of a bottle; and a closing cap (2) which is equipped with a protrusion (3) and which is connected to said pouring element (1) by way of a hinge (4);

wherein said stopper is transformable between an open configuration and a closed configuration; and wherein said protrusion (3) is disposed adjacent to, and in contact with, said pouring element (1) when said stopper is in said open configuration;

wherein said pouring element is equipped with a nozzle (10), wherein said closing cap (2) comprises a closing collar (8) which is engaged to said nozzle (10) when said stopper is in said closed configuration, and wherein said closing collar (8) is equipped with a recess (9) which accommodates said protrusion when said stopper is in said closed configuration.

2. The stopper of claim 1, wherein said protrusion (3) is semicircular in shape in a cross-sectional plane taken along its longitudinal axis.

3. The stopper of claim 1, wherein said protrusion (3) is flexible.

4. The stopper of claim 2, wherein said protrusion (3) is flexible.

5. The stopper of claim 1, wherein the protrusion (3) is circumscribed within a circle defined in the pouring element (1).

6. The stopper of claim 2, wherein the protrusion (3) is circumscribed within a circle defined in the pouring element (1).

7. The stopper of claim 3, wherein the protrusion (3) is circumscribed within a circle defined in the pouring element (1).

8. The stopper of claim 4, wherein the protrusion (3) is circumscribed within a circle defined in the pouring element (1).

9. The stopper of claim 1, wherein said hinge (4) includes first and second arms (5), and wherein said protrusion (3) is disposed between said first and second arms (5).

10. The stopper of claim 1, wherein said closing cap (2) comprises a cavity (6) which is disposed next to said protrusion (3) when said stopper is in said closed configuration.

11. The stopper of claim 1, wherein said pouring element (1) comprises at least one lateral flange (7) projecting from said pouring element (1).

12. The stopper of claim 1, wherein the closing cap (2) comprises a cantilevered cover (11), comprising a plurality of ribs (12) at its lower part.

13. The stopper of claim 1, in combination with a bottle.

* * * * *